US008448946B2

(12) United States Patent
Svatovic

(10) Patent No.: US 8,448,946 B2
(45) Date of Patent: May 28, 2013

(54) CHESSQUIRE OR CHESS100 SQUARES

(75) Inventor: Zarko Svatovic, NYC, NY (US)

(73) Assignee: Zarko Svatovic, New York City, NY (US)

( * ) Notice: Subject to any disclaimer, the term of this patent is extended or adjusted under 35 U.S.C. 154(b) by 1427 days.

(21) Appl. No.: 11/397,977

(22) Filed: Apr. 6, 2006

(65) Prior Publication Data

US 2006/0244213 A1 Nov. 2, 2006

Related U.S. Application Data

(60) Provisional application No. 60/594,677, filed on Apr. 28, 2005.

(51) Int. Cl.
*A63F 3/00* (2006.01)

(52) U.S. Cl.
USPC ..... 273/260; 273/262

(58) Field of Classification Search
USPC ..... 273/260, 261, 262, 255
See application file for complete search history.

(56) References Cited

U.S. PATENT DOCUMENTS 6,095,523 A * 8/2000 Lampman ..... 273/260
6,702,287 B1 * 3/2004 Pendexter ..... 273/261

* cited by examiner

*Primary Examiner* — Vishu K. Mendiratta

(57) ABSTRACT

This invention introduces an expanded Chess Game played on 10×10=100 square chessboard. The rules of the classic game apply as directed by FIDE (rules as of Apr. 1, 2004), with adjustments made in consideration of the larger board and added pieces. The ChessQuire/Chess 100 game introduces only one new type of chess piece named here "Esquire": white squares bound and black squares bound; four of them in total, two on each side of the board, belonging to the two opposing sets. Esquire's properties and behavior are somewhere in between that of a Knight and a Bishop. The other notable changes are the extra four pawns on the board; two on each side, and a slight pawn move rules modifications such as the en-passant rule and castling. My goal was to expand the classic game in such a way that the classic game's integrity and soul stay preserved. The game can be played at chessquire.com.

1 Claim, 4 Drawing Sheets

Figure 3:
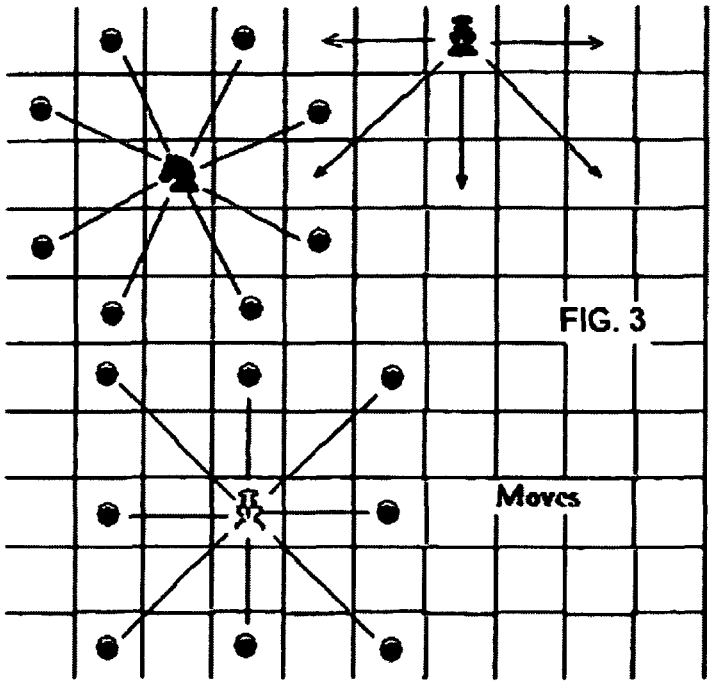

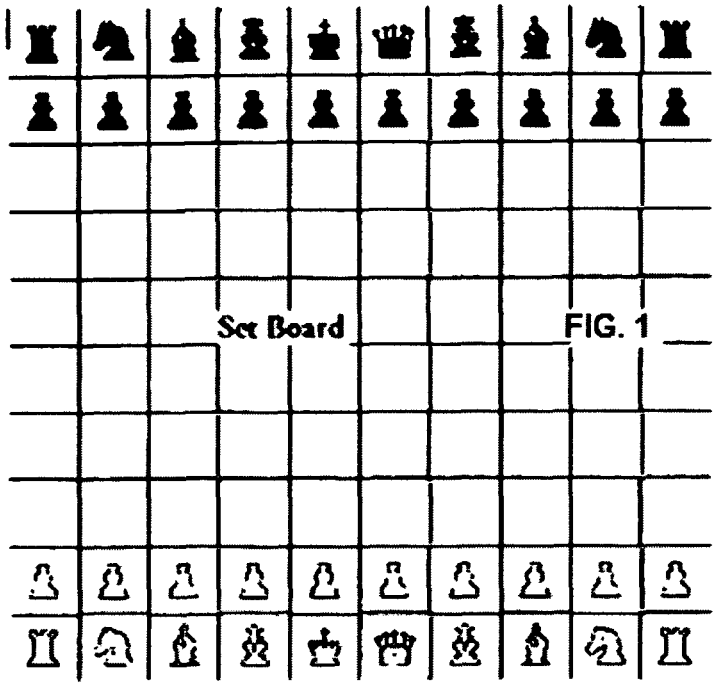
Set Board FIG. 1
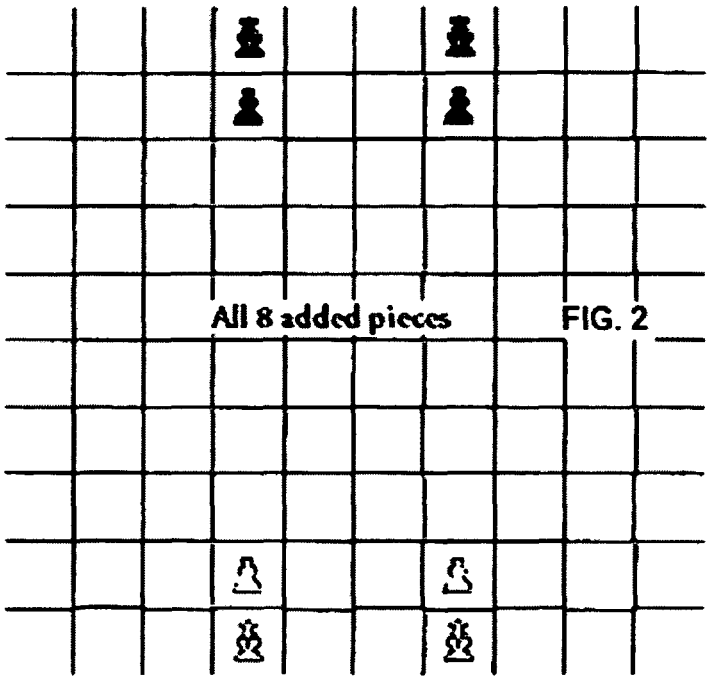
All 8 added pieces FIG. 2

CHESSQUIRE OR CHESS100 SQUARES

This Non-Provisional Application is based on Chess100 squares Provisional Application: No. 60/594,677, USPTO Cust#:52975 Timestamp: 2005-04-28 12:36:43 EDT

BRIEF SUMMARY

Expanded chess game and method therefore: This invention introduces an expanded Chess Game played on 10×10=100 square chess board (instead of classic 8×8=64 squares game). The goal of the design for the expanded game was and the main perceived achievement of the new game is that ChessQuire/Chess100 preserves the integrity, simplicity of rules and elegance of the classic game in the introduced expanded framework.

In addition to that, the extended "Free-for-all" subset of the ChessQuire game introduces a new additional aspect of the game with a range of new possibilities.

| | | |
|---|---|---|
| Sole Inventor: | Svatovic, Zarko: Tel: 646-232-6663 250 Mercer Street, NYC, N.Y.-10012 | Date: Apr. 26, 2003 |
| References Cited: | | |
| Patent: | | |
| 5,421,582 | Ritter | Jun. 6, 1995 |
| 5,690,334 | Duke | Nov. 25, 1997 |

Other:

"The F.I.D.E. Laws of Chess," http://www.fide.com/official/handbook.asp?level=EE101 References, support materials and patents listed within the published disclosure documents of U.S. Pat. Nos. 5,421,582 and 5,690,334, the two issued patents that are the most relevant to my invention.

Note: The game can be played on the Internet at ChessQuire.com.

BACKGROUND OF THE INVENTION

1. Field of the Invention

This invention relates in general to chess board games and in particular to an attempt at improving on the most popular version of the conventional classic chess game. The classic Chess game is world known, well defined and well documented game. The rules of the game and various tournament rules are controlled and sponsored by the FIDE World organization. I refer the background information requirement to the wealth of information available about the classical game worldwide. I will just quote a few small excerpts from those sources:

Chess is a scientific game and its literature ought to be placed on the basis of the strictest truthfulness, which is the foundation of all scientific research.—W Steinitz A team of British archaeologists has unearthed evidence suggesting that Europeans were playing chess as early as the sixth century. Until now chess historians had agreed that the game only became popular with the European elite during the 12th Century, 700 years after it was invented in China, India or ancient Persia. An ivory chess piece, excavated at a Byzantine palace in what is now southern Albania, is more than 500 years older than any previously discovered.

From its obscure origins in the Orient to the frontiers of artificial intelligence, chess has a rich history, filled with fascinating, sometimes quirky personalities.

Chess, an ancient game, evolved through centuries. It spanned over multitude of cultures both Eastern and Western. It is truly an international and global game.

2. Prior Art

An extensive analysis of the game, history of the game, references and prior art is disclosed within the U.S. Pat. No. 5,690,334 and I am referring to that with this statement as a very useful background I also used while describing my invention.

In addition to that I am presenting bellow my comments on the two patents that I found to be the most relevant to my invention:

U.S. Pat. No. 5,690,334, Duke, Nov. 25, 1997: introduces a game that is played on ten by eight square board with the board orientation opposite to the standard established by FIDE for classical game. It introduces a new type of pieces named falcon which moves by three squares in all directions. This is a very interesting attempt at solving the problem of enhancing the game but I don't find the new piece intuitive enough and to be in sync with the simplicity of the rules and the spirit of the classical game.

U.S. Pat. No. 5,421,582, Ritter, Jun. 6, 1995: introduces a game that is played on large octagonal board, one-hundred-thirty-six squares. This game also introduces a new type of piece named viceroy that moves like a checker in the game of checkers. This is also a very interesting attempt in solving the problem but I think that the introduced changes as a whole move the game too far from the classic original and bring an entirely new balance to the game. This is more of an entirely new game than an extension of the old one.

Perceived Advantages of Chess 100 Invention

With introduction of ChessQuire/Chess 100 the classical game was significantly expanded. The consequence of the new larger board and the added pieces is a new game that has exponentially more possibilities than the classical game.

However, in contrast to the magnitude of the impact they cause, the introduced changes in respect to the classical game are small, simple, intuitive and in sync with the classical game. There is no learning curve in adapting the ChessQuire/Chess100 game. Any chess player with basic understanding of the classical game can start playing the game right away. No significantly new concepts were introduced. Even though it shall take years to fully understand the impact of the introduced changes on the playing strategies of the new game, the well understood principles learned through centuries of playing the classical game will be still relevant. I consider this a major strength of this innovation. ChessQuire/Chess100 is truly the next development step of the original game that I was searching for.

SUMMARY OF THE INVENTION

I will define ChessQuire/Chess100, the new extended version of the classical game, strictly as an extension to the existing classic game and describe only the differences between the two. A thorough knowledge of the classical game and its rules as defined by FIDE is fundamental to understanding of the enhanced new game and my claims. The introduced novelties are:

New 100 squares board

The new board is 10×10=100 squares—see Picture 1

New Piece Type—Esquire

There are four new Esquire pieces on the board, two black and two white. Each opposing set of pieces has one white and one black square bound Esquire. Viewing the set board from white pieces side, one Esquire is located next right to the Queen and the other next left to the King—see Picture 1

Esquires move two squares vertically, horizontally or diagonally each time jumping over one square. In that respect they are similar to a Knight except that they move in strait lines, not in "L" shape. Esquire is a new type of chess piece that moves always only over the same color of the squares, it is square color bound like a Bishop.—see Picture 3

Additional Pawns

There are four more additional pawns on the board, two of each color. They are located in front of each Esquire.—see Picture 2

Pawns First Move Rule Modification

All the pawns on-the-first move now can advance one, two or three moves. The three move option was added so that the pawns can reach the center of the enlarged board as before. Other than that the pawns move and promote as before.—see Picture 4

En-Passant Rule Expansion

Due to now added ability of pawns to move three squares at a time on-the-first move the en-passant can now occur also on the fourth row and seventh row of the board respectively. The manner in which the en-passant is executed stays the same. The opposing pawn takes the advancing pawn over the field it is guarding/attacking, the field the advancing pawn is trying to bypass.—see Pictures 5 & 6

Castling

In the new game there is one more added column on each side of the King, that is one more column on each side between the rook and the King, necessitating an extra space move of the king, to the left or to the right, in order to reach one of the two possible castling positions. Relative to the corners of the board, the castling positions of the Kings, after the castling is executed, are the same as the existing positions in the classical game, albeit reversed for white and black King respectively as far as the long/short castling sides are concerned. The white King is now closer to the left side of the board and black King to the right side—as viewed from each respective side. Therefore, Kings shall castle under the same rules as before except that the Kings will move one more space to the left or to the right respectively when the castling move is executed.—see Picture 7

THE EMBODIMENTS OF THE INVENTION

Preferred Embodiment

The ChessQuir/Chess100 game is played by the rules of classical chess game as defined by FIDE with consideration given to the introduced changes: changes made to the board size, addition of pawns, addition of one new type of piece named Esquire as described earlier and accordingly enhanced and adjusted rules. Even though, the Free-for-all version of the ChessQuire game is clearly distinct from the main embodiment of the game it is considered to be an additional option, an extension of the main game.

The preferred embodiment of the game is described in detail earlier in this document and further detailed in the claims section. The preferred embodiment is considered to be the final and the best solution for the expanded game.

The initial setup of pieces stays as close as possible to the classical game setup of pieces. Due to introduction of two new columns and in respect of the requirement that white queen initially starts from a white square and black from black, the relative starting positions on the first and the last row of the board for Kings and Queens are reversed. That is, the white King is now left of the white Queen. The most significant and obvious impact of that change is on the respective castling moves of Kings, short vs. long castle. The sides in that respect are now reversed for the white and the black Kings. All the other pieces that also exist in the classical game are relatively speaking at the same initial positions on the board as they are in the classical game. The initial position of Esquires is next to King and Queen with additional pawn in front of each.

The Esquire piece with its excellent fit into the existing architecture of the classical game, does not alter the overall balance of the game. The relative powers of other pieces stay the same as well as the significance of pawns in the possible playing strategies. Esquire's existence and its properties are as if predetermined, as if they were the only meaningful such option available. I experienced materialization of the idea for this piece within the new context as a discovery; something that was there, obvious but at first hard to see. After that discovery all the other elements of the puzzle needed to define the new game. The rest of the changes to the classical game were so obvious that they practically wrote themselves. Esquire compliments Knight and Bishop and creates endless new strategic possibilities. The possibilities are humbling in their sheer magnitude and their examination not within the scope of this document. I will trust the further explorations to others in time.

I see Esquire as a hybrid piece, a cross between a Knight and a Bishop. Esquire can hop like a Knight but it is bound to single color squares like a Bishop. Because of those properties it offers quite a range of new intriguing possibilities to cooperate especially well with Knights and Bishops as well as with the other pieces of the classical game. However, the strength and value of the Esquire piece does not come up from its novelty or the ways the piece moves, which is quite unremarkable and based on similar ideas and concepts already existing and in use within the classical game and other games. The significance and value of the Esquire arises from the marvelous way it fits within the contexts and the architecture of the classical game.

The physical appearance of the Esquire is not important and any, preferably imaginative, solution would do as long as the piece is clearly distinguishable from the others, this being further in agreement with the classical game which comes in infinite number of physical forms and shapes. The name chosen for the piece maintains the tradition of the other names for pieces of the classical game, which are of medieval origin. In the Webster Dictionary an esquire is defined as a nobleman, one level below the knight.

It is expected that the time demand, the time needed to complete the ChessQuire/Chess100 game will be greater than the one needed for the classical game because of significant increase in the complexity of the game. Further experiences with the game will determine the meaningful time limits. However, for the time being, Chess100 will use FIDE defined time rules of the classical game.

Other Embodiments

The preferred embodiment of the game is described in detail throughout this document. The preferred embodiment is considered to be the final and the best solution for the ChessQuire/Chess 100 expanded game.

The Free-for-all embodiment of the game enforces all the rules of the ChessQurie game as defined in the preferred embodiment of the game except for the rules of initial setup and the number of pieces set on the board at the beginning of the game. Except for the King, only one allowed per set, there are no restrictions on the location and the number of pieces on the board as long as they are of the type available in the ChesQuire set. However, certain positions would be meaningless, like placing a king next to a king or placing a king in a mate position. Eliminating those positions will be a challenge of proposing the initial setup. Obviously, certain rules, like those regarding castling or exercising the first move of a pawn, may not apply due to specifics of the setup. The owner of the table proposes the initial setup and any specifics if necessary. The challenger accepts proposal or the challenger may negotiate changes with the owner of the table before the start of the game. The Free-for-all game can be seen as a continuation of an interrupted ChessQuire game, from a certain position on, except for the fact that certain positions possible to set up could never be reached playing regular game because of the free placement of additional pieces. The Free-for-all game can be also seen as creating ad-hoc subset of sub-games within the framework of the ChessQuire game. However, those Free-for-all sub-games are considered part of the expanded ChessQuire game. The Free-for-all version of the game as well as the preferred embodiment of the game can already be played at ChessQuire.com, the electronic Internet based rendition of the game.

See picture 8 for an example of a possible "Free-for-all" game initial setup as it was set at ChessQuire.com.

A version of the Free-for-all game can be played so that new pieces can be added during the game by the rules agreed upon between opponents with or without some initial set of pieces, perhaps with only kings being set at the beginning of the game.

Other than that, slight modification to the rules of movement of pieces for instance, such as taking away the ability of the esquire to hop over pieces, adding ability to additionally move one two or three squares, or the arbitrary name changes, or modifying order of pieces at the start of the game, or modifying the castling rule, or changing orientation and size of the board, or decreasing or increasing the number of rows with adjusting en-passant rule and such, or any combination of such changes are valid options, but in my opinion, weaker alternatives of the ChessQuire/Chess 100 game. Those permutations are options considered available within the non-preferred embodiment of the Chess 100 game and within the scope of the claims of this invention and are therefore protected by the claims of this disclosure.

DRAWINGS DESCRIPTIONS

FIG. 1

New 100 squares board illustration: The new board is 10×10=100 squares. FIG. 1 illustrates the Chess 100 board initial setup with pieces. In comparison to the classical chessboard set, the most right square on the first bottom row of the board remains white as it is in the classical game, as a marker for the orientation of the board. However, in order to maintain the classical game convention, requiring that black and white Queens initially start from the same color square as the color of their body, the black and white King's positions are now reversed when compared to the classical chess game, i.e. the white King is left of the white Queen.

FIG. 2

Esquires and additional pieces illustration: There are four new Esquire pieces on the board, two black and two white. Each set of pieces has one white and one black square bound Esquire. They move vertically, horizontally or diagonally each time jumping over one square. In that respect they are similar to a Knight except that they move straight, not in "L" shape. Esquire is a new type of chess piece that moves always over the same color of the squares, it is square color bound like a Bishop and it can never reach some squares on the board. One Esquire is located next left to the King and the other is located next right to the Queen. There are four more pawns on the board, two of each color located in front of each Esquire. FIG. 2 shows all the pieces added to the classical game set.

FIG. 3

Esquire moves illustration: Shows all the possible moves of one of the white developed Esquires in comparison to all the possible moves of a developed black Knight. Also illustrated are possible moves of an undeveloped black Esquire.

FIG. 4

Figure 4:
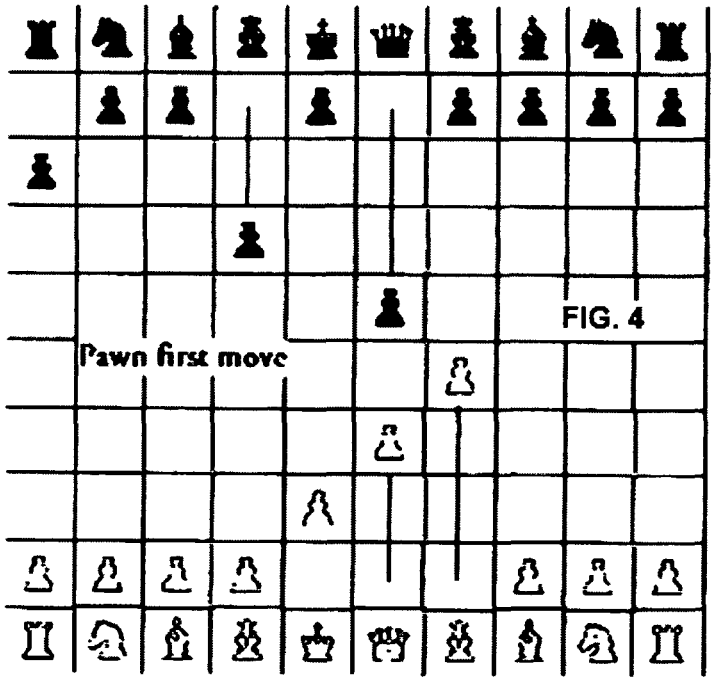

Pawns first move illustration: FIG. 4 shows the three possible options for a pawn to move on-the-first move. Pawns on-the-first-move rule modifications: All the pawns on the first move can now advance one, two or three squares. The three move option was added so that the pawns can reach the center of the enlarged board on the first move as it is done in the classical game. Other than that the pawns move and promote as before. Other change is that, after reaching the tenth row, a pawn can also chose to promote into Esquire.

FIG. 5

Figure 5:
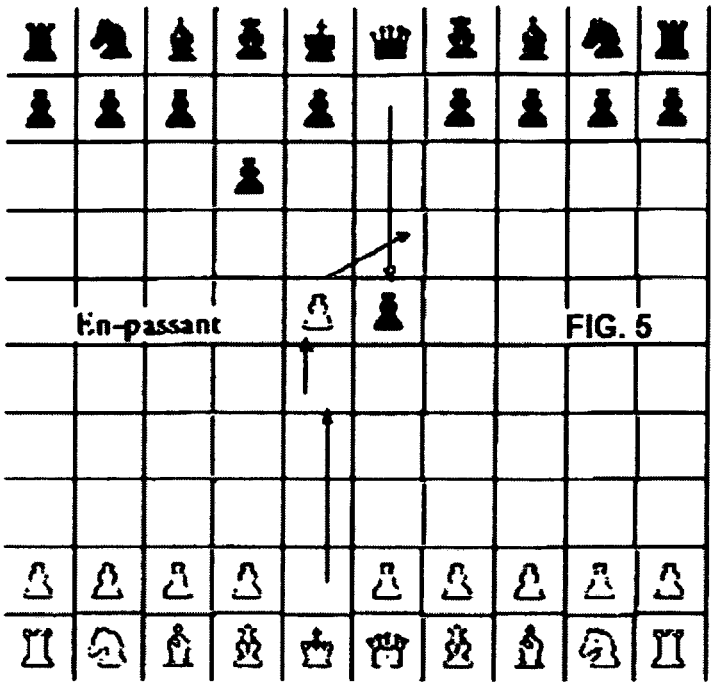
Figure 6:
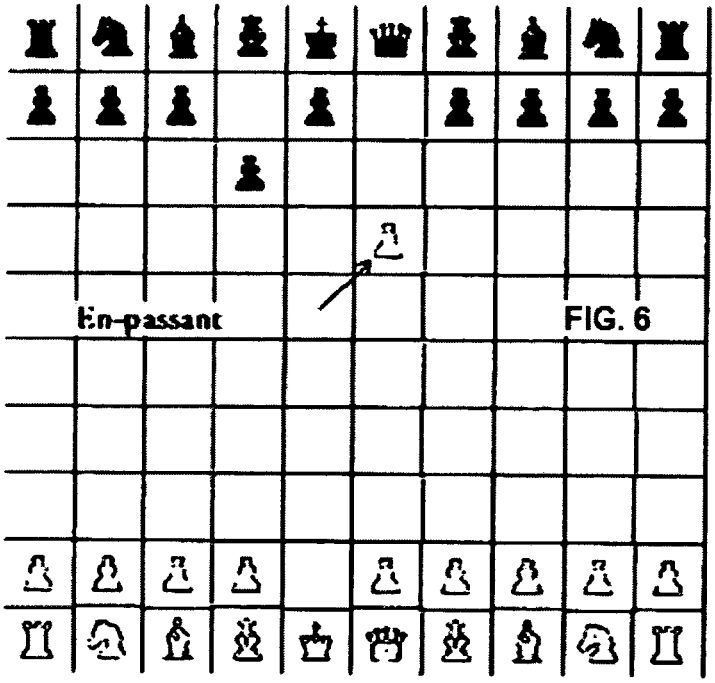

En-passant rule expansion illustration: Due to now added ability of pawns to move three squares at a time on-the-first-move the en-passant take can now occur also on the fourth row of the board, counting from each respective side. The manner in which the en-passant is executed stays the same. The opposing pawn takes the on-the-first-move advancing pawn over the field it is guarding/attacking. FIG. 5 shows position before the en-passant take.

FIG. 6

En-passant rule expansion illustration: Position after the en-passant take.

FIG. 7

Figure 7:
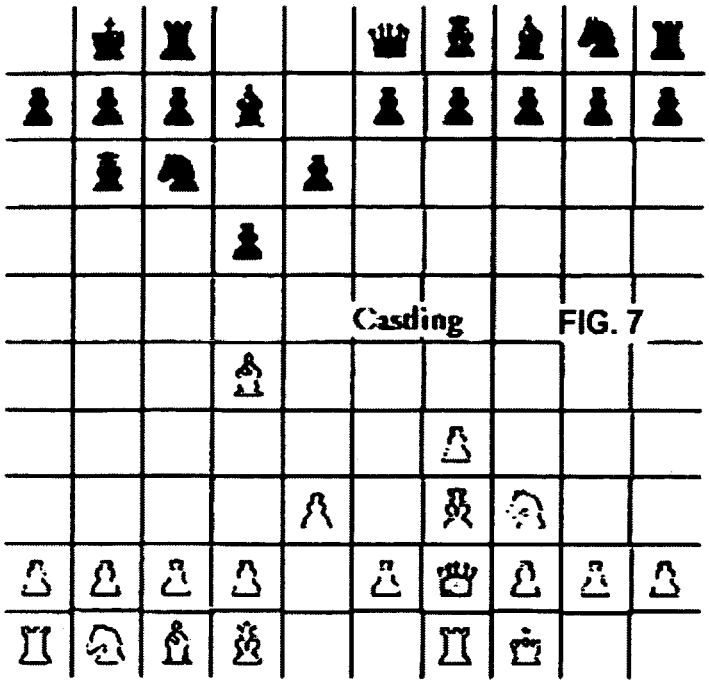

Castling Illustration, position after castling: There is now an added row on each side of the King necessitating an extra space move of the King to the left or right in order to reach the same castling positions as in the classic game. King shall castle under the same rules as before except that the King will move one additional space to the left or right side respectively when the castling move is executed. FIG. 7 illustrates black King after a "short side" castle and white King after a "long side" castle. It should be noted that because of the added columns, the position of white and black Kings facing each other at the start of the game is exactly reversed when compared to classical game. White King is left of the Queen and black King is on the right side of the Queen. White Kings "short side" castle side is now on the left side and black Kings is on the right side, in reverse when compared with classical game.

FIG. 8

Figure 8:
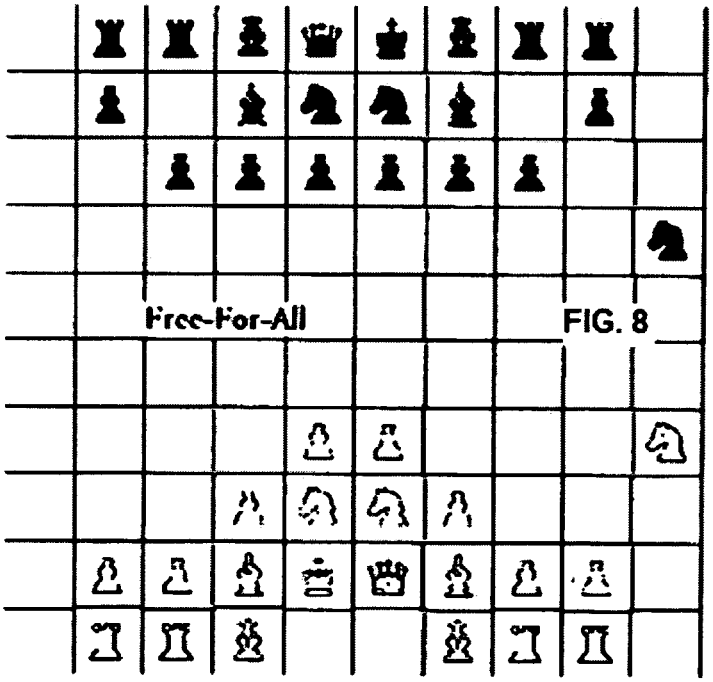

"Free-for-all" version of the game illustration: FIG. 8 illustrates a possible initial position of black and white pieces before the start of the game. The opponents among themselves within the framework of ChessQuire game decide freely and agree with no restrictions on the starting position and the number of pieces they are playing with on each side. After that the game is played by the ChessQuire/Chess 100 rules as far as they are enforceable. The internet rendition of the game will enforce all the rules of play. ChessQuire can be played worldwide at ChessQuire.com (Note: not all the aspects of the game are yet implemented.)

What is claimed is:

1. A method of playing a modified chess game by a first player against a second player, comprising the steps of:

(a) providing a game board consisting of ten horizontal rows and ten vertical columns of squares having alternating light and dark colors, squares having the same properties as the squares of orthodox chess;

(b) providing a plurality of playing pieces, including one set of light-colored pieces for the first player and a set of dark-colored pieces for the second player, each set of pieces comprising of ten pawns, one king, one queen, two rooks, two bishops, two knights, and two esquires;

(c) initially positioning the set of light-colored pieces, at the start of the game, in the first row of ten squares at a first end of the game board from left to right in the sequence, rook, knight, bishop, esquire, king, queen, esquire, bishop, knight, and rook, with the light-colored pawns being initially positioned, one pawn in each square of the second row of ten squares;

(d) initially positioning the set of dark-colored pieces in the tenth row of ten squares at the opposing end of the game board, from left to right in the sequence, rook, knight, bishop, esquire, king, queen, esquire, bishop, knight, and rook, with the dark-colored pawns being initially positioned, one pawn in each square of the ninth row of ten squares;

(e) formatting rules of movement for play wherein each of the queens, the rooks, the bishops, the knights have the same rule of movement as the corresponding piece in orthodox chess;

(f) formatting rules of movement for play wherein each of the kings have the same rule of movement as the corresponding piece in orthodox chess except that the kings move three squares towards the rook instead of two during castling;

(g) formatting rules of movement for play wherein each of the pawns have the same rules of movement as the pawns of orthodox chess, except that each pawn, on its first move, may move forwardly one, two or three squares;

(h) formatting rules of promotion movement of the pawns wherein each of the pawns have the same rules of promotion as the pawns of orthodox chess, except that they may now promote into one more piece, the esquire;

(i) formatting rule of en-passant movement of the pawns wherein the rule stays the same as rule in orthodox chess, except that en-passant rule can now in addition to $3^{rd}$ row be applied on the $4^{th}$ row;

(j) formatting rules of movement for play wherein each of the esquires moves to a square two squares in either horizontal, either vertical or either diagonal direction; and (k) formatting rules of movement for play wherein each of the esquires may move over other pieces.

* * * * *